US005987875A

United States Patent [19]

Hilburn et al.

[11] Patent Number: 5,987,875

[45] Date of Patent: Nov. 23, 1999

[54] PILOT NOZZLE STEAM INJECTION FOR REDUCED $NO_X$ EMISSIONS, AND METHOD

[75] Inventors: Margery Norcom Hilburn; David Marchant Parker, both of Oviedo; Joseph Scott Markovitz, Sanford, all of Fla.

[73] Assignee: Siemens Westinghouse Power Corporation, Orlando, Fla.

[21] Appl. No.: 08/892,662

[22] Filed: Jul. 14, 1997

[51] Int. Cl.[6] ..... F02C 3/30

[52] U.S. Cl. ..... 60/39.05; 60/39.3; 60/39.55

[58] Field of Search ..... 60/39.05, 39.3, 60/39.55

[56] References Cited

U.S. PATENT DOCUMENTS

| | | | |
|---|---|---|---|
| 4,089,639 | 5/1978 | Reed et al. | 431/211 |
| 4,259,837 | 4/1981 | Russell et al. | 60/39.55 |
| 4,629,413 | 12/1986 | Michelson et al. | 431/9 |
| 4,671,069 | 6/1987 | Sato et al. | 60/737 |
| 4,701,124 | 10/1987 | Maghon et al. | 60/39.55 |
| 4,910,957 | 3/1990 | Moreno et al. | 60/39.06 |
| 4,955,191 | 9/1990 | Okamoto et al. | 60/39.55 |
| 5,281,129 | 1/1994 | Urushidani et al. | 431/12 |
| 5,285,628 | 2/1994 | Xorenberg | 60/39.05 |
| 5,307,619 | 5/1994 | McCarty et al. | 60/39.3 |
| 5,357,741 | 10/1994 | Talabisco et al. | 60/39.05 |
| 5,361,578 | 11/1994 | Donlan | 60/39.55 |
| 5,404,711 | 4/1995 | Rajput | 60/39.463 |
| 5,408,830 | 4/1995 | Lovett | 60/73 |
| 5,415,000 | 5/1995 | Mumford et al. . | |
| 5,471,957 | 12/1995 | Brady et al. | 122/367.1 |
| 5,472,341 | 12/1995 | Meeks | 431/243 |
| 5,501,162 | 3/1996 | Kravets | 110/347 |

FOREIGN PATENT DOCUMENTS

| | | |
|---|---|---|
| 0 643 267 | 3/1995 | European Pat. Off. . |
| 3606625A | 9/1986 | Germany . |
| WO 95/31676 | 11/1995 | Russian Federation . |

*Primary Examiner*—Louis J. Casaregola
*Attorney, Agent, or Firm*—Eckert Seamans Cherin & Mellott, LLC

[57] ABSTRACT

A combustion system has a diffusion flame pilot assembly and a steam delivery assembly. The diffusion flame pilot assembly has a fuel line with a downstream end terminating at a pilot nozzle. The steam delivery assembly has a steam line terminating at a steam outlet proximate to said fuel line and upstream of said pilot nozzle for directing steam to the pilot nozzle. An aspect of the invention has a steam throttle valve for adjusting the steam flow to the pilot nozzle based on the combustion system's $NO_X$ emissions and/or characteristics of said pilot fuel stream.

13 Claims, 5 Drawing Sheets

PILOT NOZZLE STEAM INJECTION FOR REDUCED $NO_X$ EMISSIONS, AND METHOD

BACKGROUND OF THE INVENTION

This invention relates to the field of reducing $NO_X$ emissions of combustors using steam injection.

The use of petrochemical off-gas blends to generate power at refineries would be advantageous but for the hydrogen percentage and how it affects flashback and $NO_X$ emissions. Petrochemical off-gas blends have hydrogen concentrations of 30–40% by volume, which is significantly higher than that of natural gas.

High hydrogen containing fuels increase the opportunity for detrimental flashback. Hydrogen has a flame speed that is an order of magnitude higher than natural gas. As such, a hydrogen flame has an increased potential to flashback, or travel upstream into the premixing region. Extended operation under these conditions will cause a significant increase in the $NO_X$ emissions, and damage to hardware may occur.

Flashback may be avoided, but the expense of generating increased $NO_X$ emissions, by increasing the percentage of fuel to the diffusion flame pilot of the combustor relative to the total amount of fuel sent to the combustor. However, the higher fuel percentage in the diffusion flame pilot nozzle, the higher the $NO_X$ emissions.

Further, just the use of high hydrogen fuel increases the potential for increased $NO_X$ generation. The generation of $NO_X$ is increased with higher combustion temperatures. High hydrogen fuel has a higher adiabatic flame temperature than that of natural gas. Burning the high hydrogen fuel results in higher combustion temperatures which correlates to higher $NO_X$.

The prior art discloses the beneficial results of injecting steam and/or water into a combustor. The addition of steam or water into the combustor reduces the amount of $NO_X$ produced at least in part by reducing flame temperature. Further, steam/water injection also reduces $NO_2$ in the emission, resulting in elimination of yellow-tinted emissions. Steam can also be added to the combustor when it is not running at full capacity to keep $NO_X$ emissions below predetermined limits. This would be beneficial when combusting high hydrogen fuels.

The prior art discloses adding steam and/or water to the combustor such that it is distributed throughout the combustion zone of the combustor, thus generally affecting combustion. For example, U.S. Pat. No. 4,089,639 discloses premixing water vapor with fuel prior to entering the combustor. In another example, U.S. Pat. No. 5,404,711 discloses premixing water with the air stream prior to combustion.

However, the injection of steam and/or water into the combustor results in undesirably higher plant heat rates. The generation of the steam takes energy out of the plant, and increases the heat rate. The addition of steam reduces the flame temperature and, typically, combustor efficiency. Therefore, a need exists for a combustion system and method that has reduced $NO_X$ emissions and uses less steam, resulting in beneficially decreased plant heat rates.

SUMMARY OF THE INVENTION

The claimed invention provides a combustion system having a diffusion flame pilot assembly and a steam delivery assembly. The diffusion flame pilot assembly has a fuel line with a downstream end terminating at a pilot nozzle. The steam delivery assembly has a steam line terminating at a steam outlet proximate to said fuel line and upstream of said pilot nozzle for directing steam to the pilot nozzle. An aspect of the invention has a steam throttle valve for adjusting the steam flow to the pilot nozzle based on the combustion system's $NO_X$ emissions and/or characteristics of said pilot fuel stream.

DETAILED DESCRIPTION OF THE PREFERRED EMBODIMENTS

Figure 1:
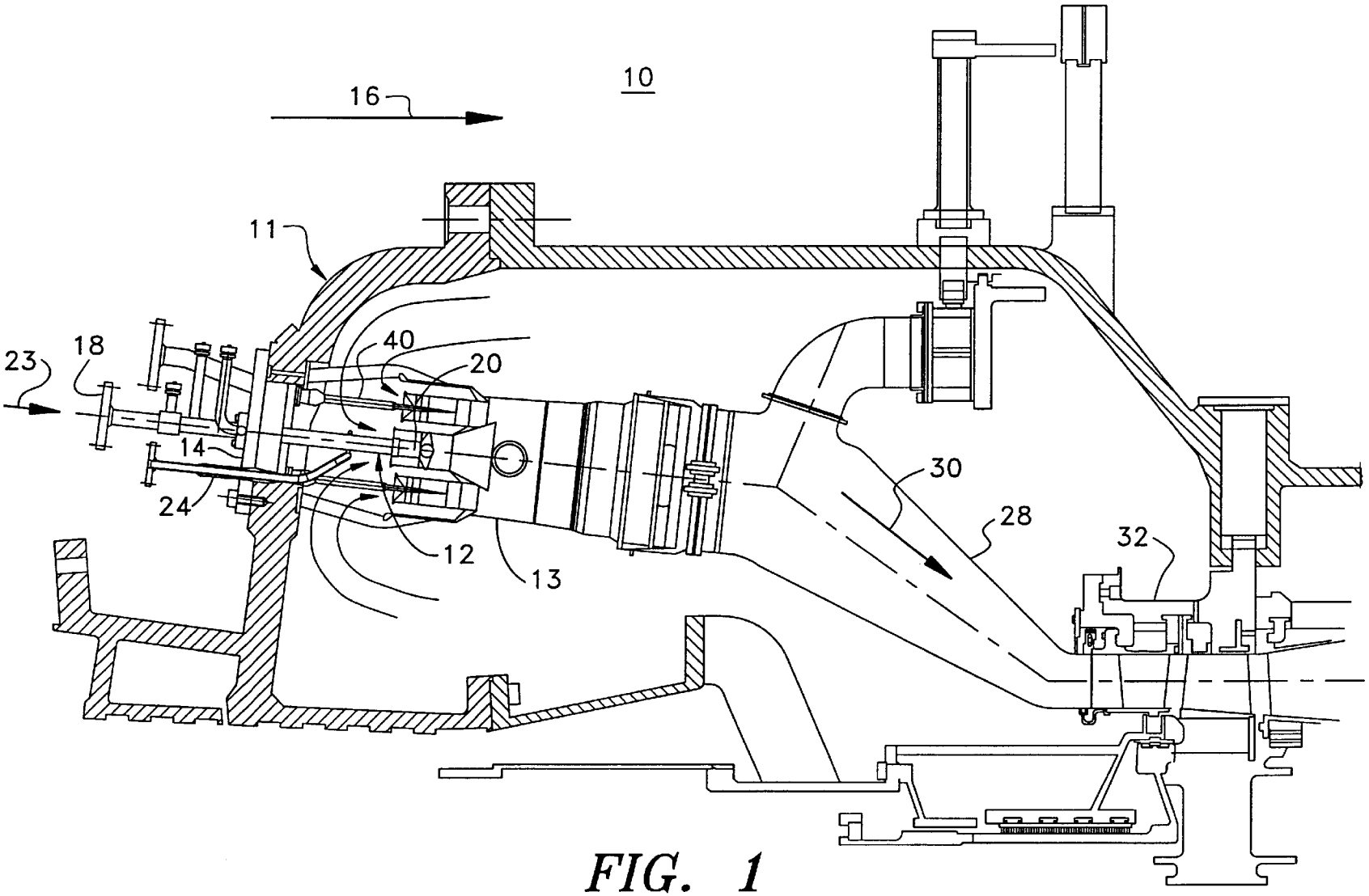
FIG. 1 is an elevational cross-section of a combustion system having a steam delivery system according to an aspect of the invention.

Now referring to the Figures, wherein like reference numerals refer to like elements, and in particular to FIG. 1, a lean premix combustion system 10 has a diffusion flow pilot assembly 12 and a steam delivery assembly 24 arranged to direct steam to a pilot nozzle 20 and not disperse it into a general fuel flow within a combustor 13. By directing the steam in this manner, approximately one tenth of the steam flow is required to control $NO_X$ compared to the prior art steam injection systems, resulting in lower operating costs and better plant heat rates. Relative to the flow direction 16 depicted as moving from left to right in FIG. 1, the diffusion flow pilot assembly 12 has a pilot fuel inlet 18 upstream of a nozzle block 14, the pilot nozzle 20 is downstream of the block, and a pilot fuel line 22 extending through the block between the inlet and the nozzle. A pilot fuel stream 23 enters the line 22 through the inlet 18. Downstream of the pilot nozzle is the ignitor 26 and the transition 28. The fuel stream 23 is burned in the combustion system and combustion emissions 30 flow through the transistion 28 and into a turbine 32 for generating rotating shaft power.

Figure 2:
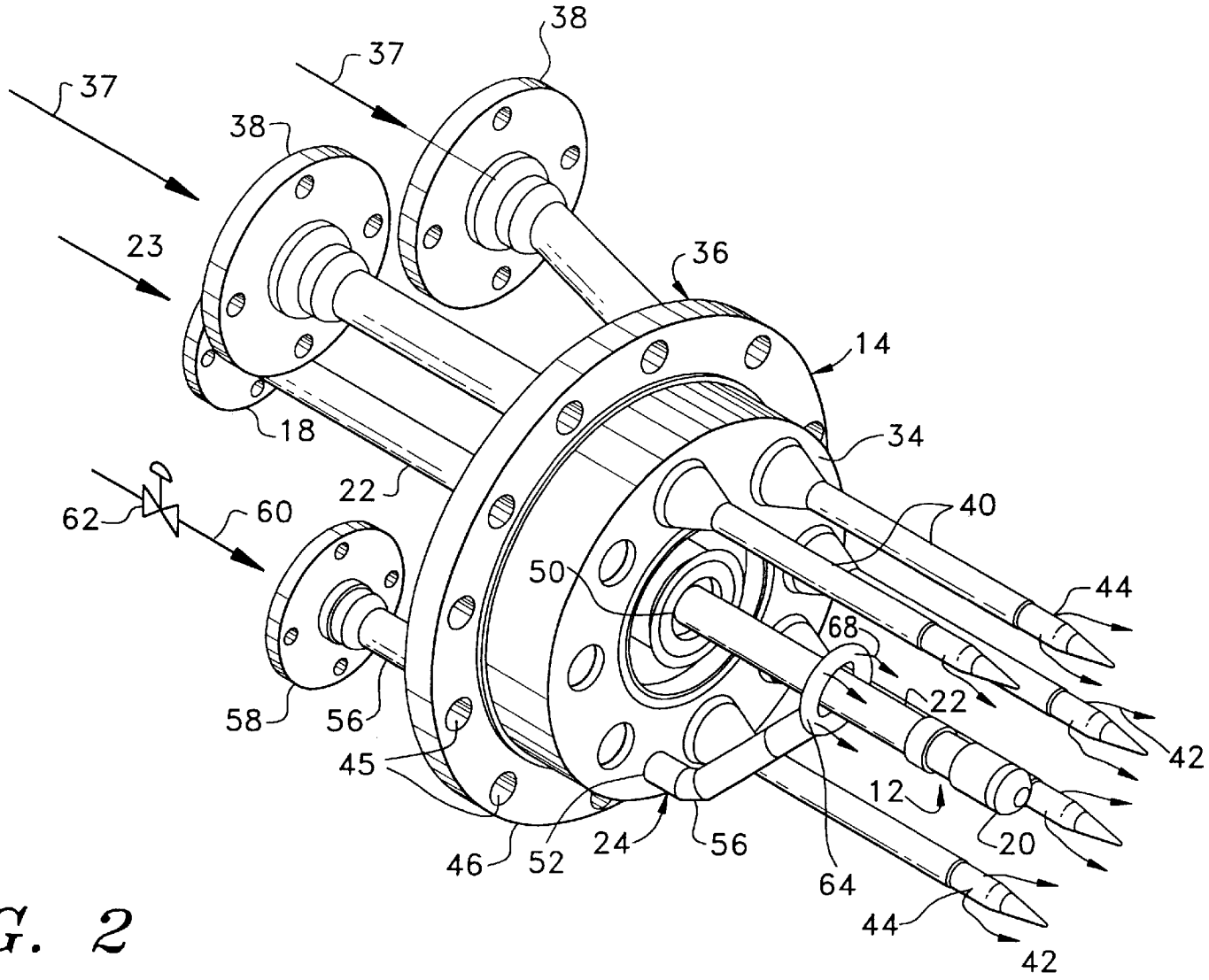
FIG. 2 is a perspective view of the nozzle block of the combustor with the steam delivery system extending through the block, according to an aspect of the invention.
Figure 3:
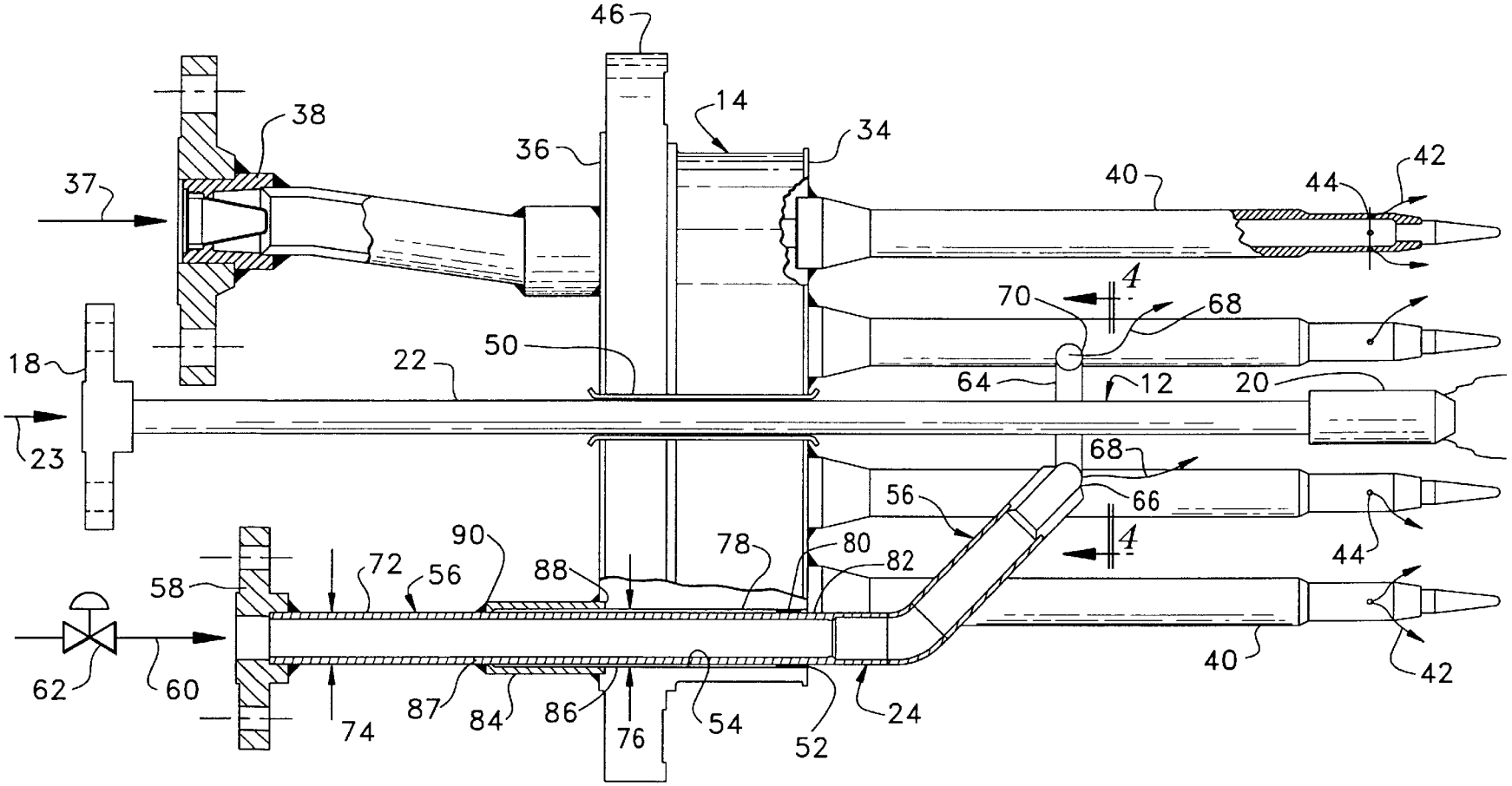
FIG. 3 is cross-section of the nozzle block of FIG. 2 along line 3—3.

Now referring to FIGS. 2 and 3, the details of the nozzle block 14, the diffusion flow pilot assembly 12, and the steam delivery assembly 24 are depicted. The nozzle block 14 is a circular apparatus with a downstream surface 34 and an upstream surface 36. The nozzle block 14 is bolted into the turbine cylinder 11 through bolt holes 45 in a flange 46 of the block. The nozzle block 14 receives the fuel streams 37 through inlets 38 and directs the fuel into the main premix nozzles 40 extending from the downstream surface 34 (only 5 of 8 premix nozzles is shown in FIG. 2, other embodiments may have more or less than 8 premix nozzles). The fuel 42 then exits the premix nozzles 40 through fuel injector ports 44 at the end of each nozzle and mixes with the combustion air flow. The pilot fuel line 22 of the diffusion flow pilot assembly 12 is disposed in a fuel line bore 50 that extends from the upstream surface 36 to the downstream surface 34 of the nozzle block.

In a preferred embodiment of the invention, a steam line 56 of the steam delivery assembly 24 extends through a cylindrical steam line bore 52 in the nozzle block 14. The cylindrical steam line bore 52 is defined by a steam line bore surface 54 that extends from the upstream surface 36 to the downstream surface 34 of the nozzle block. A steam line inlet 58, located upstream of the nozzle block 14, receives a steam flow 60. The steam flow 60 is controlled via a steam throttling valve 62.

Figure 4:
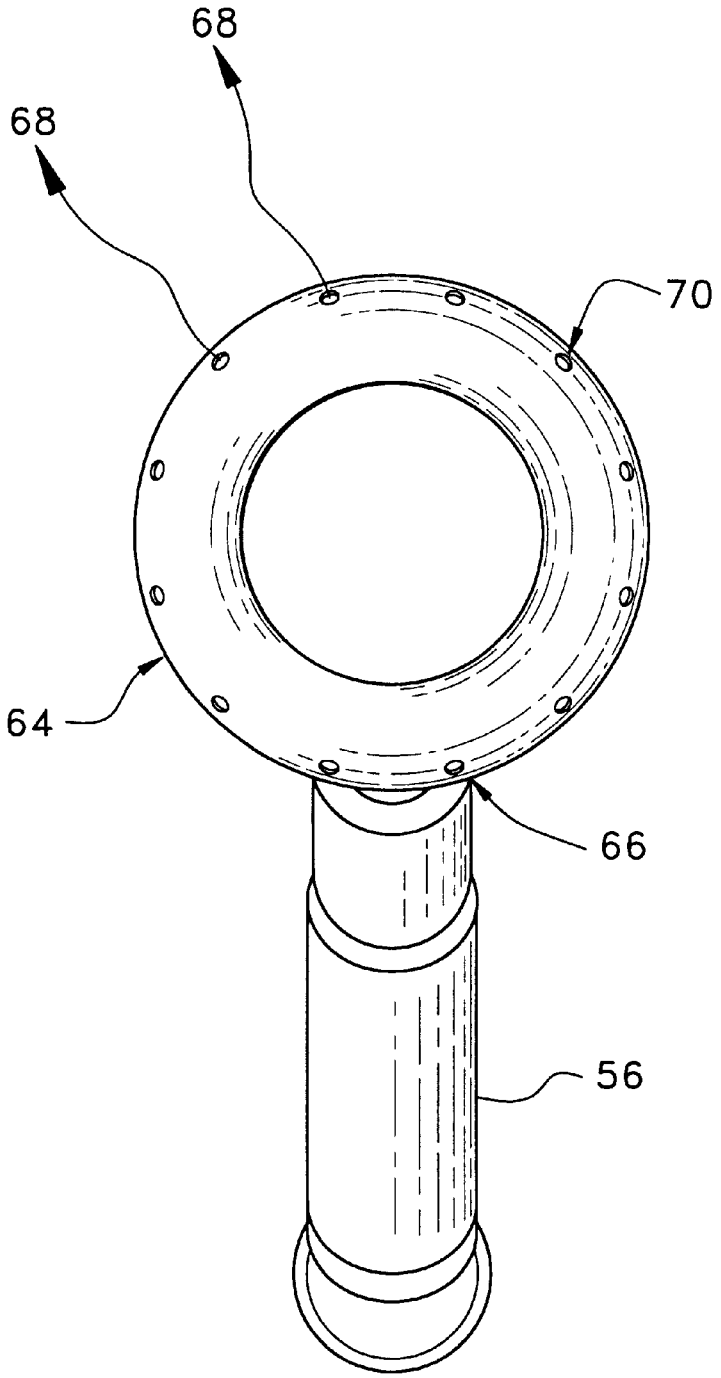
FIG. 4 is a view of a toroid steam injector in FIG. 3 along line 4–4.

In a preferred embodiment of the invention, the downstream end of the steam line 56 may terminate in a toroid steam outlet 64. The toroid steam outlet 64 surrounds the pilot fuel line 22 and is located between the nozzle block 14 and the pilot nozzle 20. The toroid steam outlet 64 receives the steam flow 60 through a steam inlet 66 and ejects a plurality of individual steam streams 68 through a plurality of ports 70 toward the pilot nozzle 20. Preferably, the ports 70 are positioned such that the stream 68 are ejected toward the nozzle 20 but away from the fuel line 22, as shown in FIG. 4. Other embodiments of the invention may use other equivalent means for injecting the plurality of individual steam streams 68 toward the nozzle 20 from a plurality of locations around the fuel line 22.

In a preferred embodiment of the invention, the steam line 56 is installed in the steam line bore 52 such that thermal gradients are inhibited in the region of the nozzle block proximate to the steam line 56. The steam line 56 has an outside diameter 74 that is smaller than the bore diameter 76 of the steam line bore 52. This results in an air gap 78 forming between the steam line bore surface 54 and the outside surface 72 of the steam line 56. The air gap 78 inhibits thermal gradient formation in the nozzle block 14. To also inhibit thermal gradient formation, the steam line 56 is connected to the block at only one location. A sleeve 84 connects the upstream end 86 of the steam line bore surface 54 to a steam line contact location 87 that is upstream of the nozzle block 14. The down stream end 88 of the sleeve 84 is welded to the upstream surface 36 of the nozzle block 14 and aligned the upstream end 86 of the steam line bore surface 54. The sleeve 84 terminates with an upstream end 90 that is welded to the steam line contact location 87, thereby making the connection between the block and the steam line. The sleeve 84 inhibits thermal gradients in the nozzle block 14 by enabling the sleeve to develop and maintain a thermal gradient. A close-fit location 80, positioned near the downstream end 82 of the steam line bore surface 54, necks in the surface 54 to further support the steam line.

The invention may operate using variable amounts of steam flow 60 to attain desired plant heat rates and emissions based on the pilot fuel composition and other variables. When the pilot fuel stream 23 is standard natural gas fuel, less $NO_X$ is produced and the invention may operate 'dry' or without steam. Since steam is not being used, the plant heat rate is advantageously low. When the pilot fuel stream 23 has heavier hydrocarbons than methane, such as propane and butane in quantities more than about 6–7% by volume, the $NO_X$ composition shifts to $NO_2$. Increased amounts of $NO_2$ result in undesirable yellow-tinted emissions. The injection of steam into the pilot nozzle reduces the $NO_2$, the $NO_X$, and the yellow tint of the emissions. When the pilot fuel stream 23 has even heavier hydrocarbons, such as hexane, heptane, and octane, the resulting higher flame temperature contributes to increased $NO_X$ emissions. The injection of steam into the nozzle reduces the flame temperature and the $NO_X$ emissions.

The steam throttling valve 62 can be operated to adjust the steam flow 60 to accommodate different situations such that the combustion system has desirable emissions and optimum plant heat rates. Further, the steam flow required to affect these changes is approximately one tenth of the steam flow required in the prior art steam injection systems, resulting in lower operating costs and lower plant heat rates. The steam flow may also be adjusted to accommodate for partial loading of the combustion system.

EXAMPLE

Figure 5:
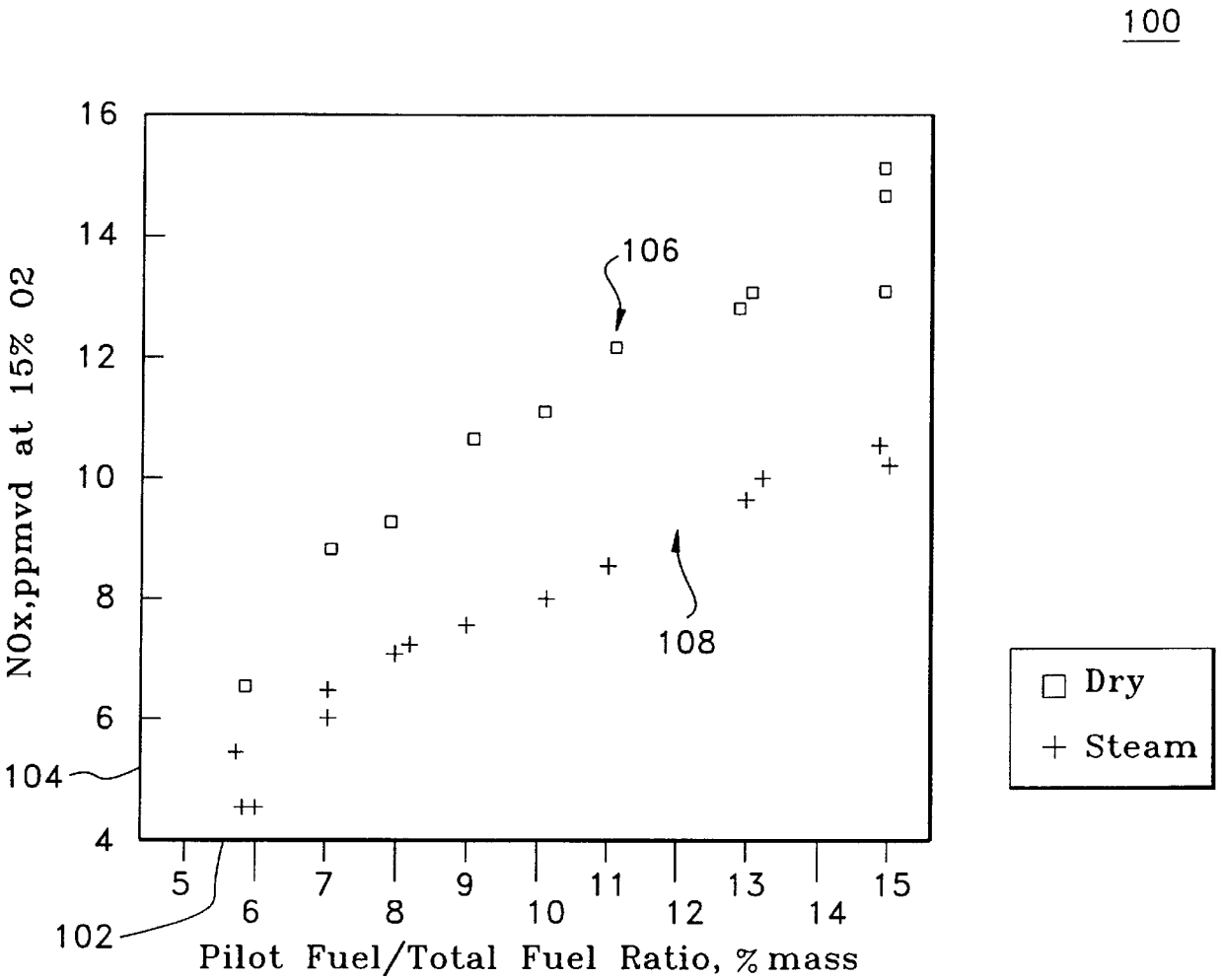
FIG. 5 is a graph entitled "Natural Gas with Steam Injection From Toroid Positioned Five Inches from Nozzle Block."

A test was performed to determine the influence injecting steam to the pilot nozzle has on $NO_X$ emissions. Referring to FIG. 5, a graph 100 entitled "Natural Gas with Steam Injection From Toroid Positioned Five Inches from Nozzle Block" has an x-axis 102 labeled "Pilot Fuel/Total Fuel Ratio, % mass," and a y-axis 104 labeled "$NO_X$, ppmvd at 15% O2." The graph 100 has a first set of data 106 that represents $NO_X$ emissions without steam injection. The graph 100 has a second set of data 108 that represents $NO_X$ emissions with steam injection to the pilot nozzle.

The test found that injecting steam to the pilot nozzle produced reduced $NO_X$ emissions for comparable ratios of pilot fuel to total fuel. For example, at a pilot fuel/total fuel ratio of 6%, emissions produced without steam injection were approximately 6.5 ppmvd $NO_X$ at 15% $O_2$ while the emissions with steam injection were approximately 4.5. At the higher pilot fuel/total fuel ratio of 15%, the emissions produced without steam injection were approximately 15, while the emissions with steam injection were approximately 10.5.

The test also relates the direct influence that the pilot fuel combustion has on $NO_X$ emissions. As the pilot fuel/total fuel ratio increases, so does the $NO_X$ emissions. When testing the combustion system without steam, the $NO_X$ emission level rose from 6.5 to 15 as the ratio increased from 6% to 15%. When tested with steam, the $NO_X$ emission levels rose again from 4.5 to 10.5 as the ratio increased from 6% to 15%. Therefore, pilot fuel combustion significantly contributes to the $NO_X$ emissions, and the invention economically reduces the $NO_X$ emissions by directing a relatively small flow of steam to the pilot nozzle.

This invention may be practiced with gaseous or liquid fuels. In a preferred embodiment, the invention may be practiced with high hydrogen fuels, or more specifically, petrochemical off-gas blends. Consequently, the present invention may be embodied in other specific forms without departing from the spirit or essential attributes thereof and, accordingly, reference should be made to the appended claims, rather than to the foregoing specification, as indicating the scope of the invention.

We claim:

1. A combustion system comprising:

a diffusion flame pilot assembly having a fuel line with a downstream end terminating at a pilot nozzle; and a steam delivery assembly having a steam line terminating at a steam outlet proximate to said fuel line and upstream of said pilot nozzle wherein said steam outlet is a steam injection toroid surrounding said fuel line.

2. The combustion system of claim 1 wherein said steam injection toroid has a plurality of steam injection ports directed toward said pilot nozzle and away from said fuel line.

3. A combustion system comprising:

a diffusion flame pilot assembly having a fuel line with a downstream end terminating at a pilot nozzle;

a steam delivery assembly having a steam line terminating at a steam outlet proximate to said fuel line and upstream of said pilot nozzle;

a nozzle block comprising:

upstream and downstream surfaces; and a bore surface extending between said upstream and downstream surfaces defining a steam line bore through which said steam line extends, wherein said pilot nozzle and said steam outlet are downstream of said nozzle block; and wherein:

a) said steam line has an outside surface and an outside diameter;

b) said steam line bore has a bore diameter greater than said steam line outside diameter; and c) said steam line bore surface and said steam line outside surface define an annular air gap.

4. The combustion system of claim 3 wherein:

a) said steam line bore has an upstream opening; and b) said steam delivery assembly further comprises a sleeve with a first end attached to said nozzle block and aligned with said steam line bore upstream opening, said sleeve terminating with a second end that extends upstream of said nozzle block and is in contact with said steam line outside surface.

5. The combustion system of claim 2 wherein said steam delivery assembly comprises a controllable, steam flow throttling device in said steam line.

6. The combustion system of claim 5 further comprising a nozzle block comprising upstream and downstream surfaces and a bore surface extending between said upstream and downstream surfaces defining a steam line bore through which said steam line extends, wherein said pilot nozzle and said steam outlet are downstream of said nozzle block;

wherein:

a) said steam outlet is a steam injection toroid surrounding said fuel line, with steam injection ports directed toward said pilot nozzle and away from said fuel line;

b) said steam line has an outside surface and an outside diameter;

c) said steam line bore has a bore diameter greater than said steam line outside diameter and an upstream opening;

d) said steam line bore surface and said steam line outside surface define an annular gap;

e) said steam delivery assembly further comprises a sleeve with a first end attached to said nozzle block and aligned with said steam line bore upstream opening, said sleeve terminating with a second end that extends upstream of said nozzle block and is in contact with said steam line outside surface.

7. A combustion system comprising:

a diffusion flame pilot assembly having a fuel line with a downstream end terminating at a pilot nozzle;

steam delivery means for injecting a steam flow toward said pilot nozzle;

wherein said steam delivery means comprises means for splitting said steam flow into a plurality of individual steam streams and passing such streams through a plurality of locations around said fuel line, respectively;

a nozzle block comprising upstream and downstream surfaces, wherein said pilot nozzle is downstream of said downstream surface, and said steam delivery means comprises steam line means for enabling said steam flow to pass through said nozzle block from said upstream surface to said downstream surface; and wherein said steam delivery means comprises insulation means for inhibiting thermal gradients in a region of said nozzle block proximate to said steam line.

8. The combustion system of 12 wherein said steam delivery means comprises throttle means for controlling said steam flow.

9. A combustion method for reducing $NO_X$ emissions out of a combustion system comprising the steps of:

enabling a pilot fuel stream to flow through a fuel line in a downstream direction and out a diffusion flame pilot nozzle;

directing a steam flow downstream toward said pilot nozzle;

wherein said directing said steam flow step further comprises the step of splitting said steam flow into a plurality of individual steam streams and passing such streams through a plurality of locations around said fuel line, respectively; and wherein said enabling said steam flow to split step further comprises the step of directing said steam flow into an inlet of a steam injection toroid disposed about said fuel line and upstream of said pilot nozzle, said steam injection toroid having a plurality of steam injection ports directed toward said pilot nozzle and away from said fuel line.

10. The combustion method of claim 9 wherein said directing said steam flow downstream step further comprises the step of passing said steam flow through a nozzle block disposed upstream of the pilot nozzle.

11. The combustion method of claim 10 wherein said passing said steam flow step further comprises the step of inhibiting thermal gradients in a region of said nozzle block proximate to said steam flow.

12. The combustion method of claim 11 wherein said inhibiting step further comprises the step of providing an air gap between said steam flow and said nozzle block.

13. The combustion method of claim 9 wherein said directing said steam flow step further comprises the step of changing said steam flow based on the combustion system's $NO_X$ emissions and/or characteristics of said pilot fuel stream.

* * * * *